US005277642A

United States Patent [19]

Dorta

[11] Patent Number: 5,277,642

[45] Date of Patent: Jan. 11, 1994

[54] COMBINATION TOY AND BEVERAGE DISPENSING DEVICE

[76] Inventor: Juan F. Dorta, 2401 W. 9th St., Los Angeles, Calif. 90006

[21] Appl. No.: 812,414

[22] Filed: Dec. 23, 1991

[51] Int. Cl.[5] ..... A63H 33/30; B67D 1/04; B65D 51/16

[52] U.S. Cl. ..... 446/76; 446/75; 446/197; 446/202; 446/267; 446/475; 222/481.5; 222/538; 215/309; 220/373

[58] Field of Search ..... 446/75, 76, 197, 202, 446/267, 475, 483; 215/1 A; 215-229, 309; 220/367, 373, 705, 709; 222/431.5, 538, 530, 464, 416

[56] References Cited

U.S. PATENT DOCUMENTS

| | | | |
|---|---|---|---|
| 1,445,643 | 2/1923 | Peron | 222/464 |
| 1,577,539 | 3/1926 | Polk | 215/309 |
| 3,099,452 | 7/1963 | Fernicola | 446/76 X |
| 3,438,527 | 4/1969 | Gamblin | 215/1 A |
| 3,823,718 | 7/1974 | Tromovitch | 222/538 X |
| 4,033,091 | 7/1977 | Saponara | 220/367 X |
| 4,059,113 | 11/1977 | Beinsen et al. | 215/309 X |
| 4,696,398 | 9/1987 | Steinmetz | 222/538 X |
| 4,830,235 | 5/1989 | Miller | 222/481.5 X |
| 4,925,040 | 5/1990 | Wang | 222/538 X |
| 4,930,645 | 6/1990 | Warehime | 446/75 X |

*Primary Examiner*—Danton D. DeMille
*Attorney, Agent, or Firm*—Robert J. Schaap

[57] ABSTRACT

A combination toy and beverage dispensing Device, primarily adapted for use with children and particularly minor children who are still consuming liquids from a bottle and similar dispensing device. The combination toy and beverage dispensing device may preferably adopt the form of a ball which a toddler can play with in a playpen or like confined area. The ball is provided with a center interior chamber holding a beverage container capable of dispensing a beverage such as milk. A stem mechanism is associated with the ball and when pushed on, enables delivery of the milk or other beverage through a drinking tube which the child user may insert in his or her mouth. A tether type supply tube is adapted to extend into the beverage, regardless of the orientation of the ball. The ball is constructed so that it will roll properly, notwithstanding the presence of the dispensing mechanism.

11 Claims, 6 Drawing Sheets

COMBINATION TOY AND BEVERAGE DISPENSING DEVICE

BACKGROUND OF THE INVENTION

1. Field of the Invention

This invention relates in general to combination toy and beverage dispensing devices and more particularly to toy and beverage dispensing device combinations which are constructed so that a child user may play with the toy and may also actuate the device for purposes of withdrawing a liquid beverage therefrom.

2. Brief Description of the Prior Art

In many cases, children, and particularly toddlers, who are necessarily confined to playpens and like areas become restless and require some stimulation as, for example, with play toys or the like. Furthermore, relatively infant children require bottles for feeding and particularly, bottles of milk or similar beverage. When the baby is finished with the bottle, he or she may resort to crying in order to have his or her needs met. Very often, it remains for the mother or other attendant to merely provide a toy in place of the bottle.

Heretofore, there has not been any effective toy and beverage dispensing combination in which the toy can function as a ball for purposes of play and also as a beverage dispensing device so that the child user can extract a beverage therefrom. There has been a need for a ball that can be used as a play item, particularly for children under four years of age. This ball must be capable of being utilized as a mechanism for feeding the child as well and which necessarily must be safe and easy to operate. Further, there has been a need for a device of this type in which there is no danger of spilling liquid when the ball is located in a playpen or similar confined area.

There have been numerous beverage dispensing bottles such as milk bottles in the prior art and which are typically of an elongate shape containing a nipple at the end for the child user to engage and draw liquid from the bottle by a sucking action. In many cases, there have been liners which are proposed for use in these baby bottles and which liners contain the milk or other liquid to be dispensed. However, beyond this, there has not been any effective combination of toy and liquid dispensing mechanism which will truly operate as a toy such as a ball and will also effectively serve as a liquid dispensing mechanism.

OBJECTS OF THE INVENTION

It is, therefore, one of the primary objects of the present invention to provide a combination toy and beverage dispensing device which is capable of being used as a toy by a relatively minor child and which can also be easily actuated by a child user for purposes of extracting a liquid beverage contained therein.

It is another object of the present invention to provide a combination toy and beverage dispensing device of the type stated in which the toy may adopt the form of a ball and which ball contains an inner container which is provided with a dispensable liquid beverage.

It is a further object of the present invention to provide a combination toy and beverage dispensing device of the type stated which is readily useable by small children and including children of toddler ages and which can also be used as a play toy even after the child has outgrown the need for drinking from a bottle.

It is an additional object of the present invention to provide a combination toy and beverage dispensing device of the type stated in which there is no possibility of liquid spillage when the child user attempts to use the toy as a toy.

It is another salient object of the present invention to provide a combination toy and beverage dispensing device of the type stated which is quite safe to use and which can be manufactured at a relatively low cost.

It is still another object of the present invention to provide a combination toy and beverage dispensing device of the type stated which can be easily disassembled for repair and cleaning and rapidly and easily reassembled for use thereof.

With the above and other objects in view, my invention resides in the novel features of form, construction, arrangement and combination of parts presently described and pointed out in the claims.

BRIEF SUMMARY OF THE DISCLOSURE

The present invention relates in general terms to a combination beverage dispensing device or so-called drinking bottle and toy playing device such as a playing ball. The device comprises an outer housing or shell of a relatively hard plastic material for housing a beverage dispensing container. The outer shell is covered by a foam plastic to provide a soft surface playing ball and an outer protective relatively soft cover therefor.

The ball may be divided into two semi-cylindrical, somewhat rigid structural halves which are connected together prior to being surrounded in the soft outer protective layer. Located within the rigid spherical retaining ball is a somewhat flexible beverage dispensing container which receives the beverage to be dispensed therefrom. A stem means is associated with the beverage dispensing container and exists in the form of at least a beverage delivery tube which has an outer end capable of being located at least at the surface of the outer housing of the ball to be engaged by the lips of a user.

The beverage delivery tube also has an inner end which extends into the beverage dispensing housing. This latter portion of the tube is of a flexible construction and the inner end thereof is weighted so that the inner end of the tube is always located within a beverage in the container, regardless of the orientation of the container.

Also associated with and forming part of the stem means is an air tube which extends into the beverage dispensing container for at least providing a compensating pressure and also aiding in the delivery of milk or other beverage from the beverage dispensing container. This air tube and the beverage delivery tube operate in combination with one another and therefore together constitute a part of the stem means.

The air tube is capable of permitting an introduction of air into the beverage dispensing container to thereby equalize the pressure in the container when the liquid is withdrawn therefrom. In a preferred embodiment, a bellows is located in the air tube and this bellows can operate as a type of pumping means in a manner to be hereinafter described in more detail. However, when operated as a pumping means, air will be introduced into the beverage dispensing container thereby aiding in the delivery of the beverage through the beverage delivery tube to the mouth of the child user. If the air pressure is sufficient, it will force the liquid directly to the mouth of the child user and if not, it can be implemented by sucking action of the child user.

The outer end of the stem means itself is normally located within the housing and does not project appreciably beyond the housing surface, if at all, when the device is used as a playing toy. Thus, in the preferred embodiment of the invention, when the device adopts the form of a ball, the beverage delivery tube is located so that the outer end thereof does not project beyond the surface of the ball.

A radially shiftable plug surrounds the beverage delivery tube and is located flush with the surface of the ball. Further, this plug has a somewhat arcuate surface contour to conform to the arcuate shape of the ball. When the child user pushes against this plug and engages the beverage delivery tube, the plug will be pushed inwardly. This action causes a compression of the bellows forcing the air previously contained in the bellows into the beverage dispensing container. In this way, the beverage in the container may be forced through the beverage delivery tube in the manner as previously described, or otherwise, it will provide a positive pressure assist in the delivery of the beverage through the beverage delivery tube.

The combination of the plug and the bellows, along with the air tube and the beverage delivery tube, operate as a type of actuating means. Thus, when the plug is pushed inwardly, the child user actually actuates the beverage delivery system by causing a pressure build-up in the beverage dispensing container as a result of the contraction of the bellows. This pressure build-up starts the release and delivery of the beverage in the manner previously described. In like manner, when the child releases the pressure against the plug, the plug will shift outwardly causing the stem to be retracted inwardly within the housing and thereby stop the flow of beverage through the beverage delivery tube. In addition, since the outer end of the beverage delivery tube is retracted within the housing, the device can then be used as a playing ball or other type of toy.

A tube blocking mechanism is also provided with part of the dispensing apparatus. The tube blocking mechanism is associated with the previously described plug. The tube blocking mechanism will automatically crimp and block the beverage delivery tube when the child user does not push against the plug at the surface of the ball. In like manner, the tube blocking mechanism will permit an automatic release of this crimping action when the child user does push against the plug in an attempt to withdraw milk or other beverage from the beverage dispensing container. In this way, the device is essentially fail-safe in that there will be no delivery of milk and further, there will be no leakage of milk or other beverage when the device is used as a toy.

The ball itself is also weighted so that it will roll in the same manner as a ball, regardless of the orientation of the ball. The beverage dispensing mechanism itself creates some added weight and also shifts the normal center of gravity of the ball. As a result, the ball would be weighted along one side. The additional weight in the outer shell to offset this additional weight of the beverage dispensing mechanism enables the ball to truly roll as a ball.

This invention possesses many other advantages and has other purposes which may be made more clearly apparent from a consideration of the forms in which it may be embodied. These forms are shown in the drawings forming a part of and accompanying the present specification. They will now be described in detail in the following detailed description of this invention for the purposes of setting forth the general principals of the invention. However, it is to be understood that the accompanying drawings and the following detailed description is not to be taken in a limiting sense.

BRIEF DESCRIPTION OF THE DRAWINGS

Figure 1:
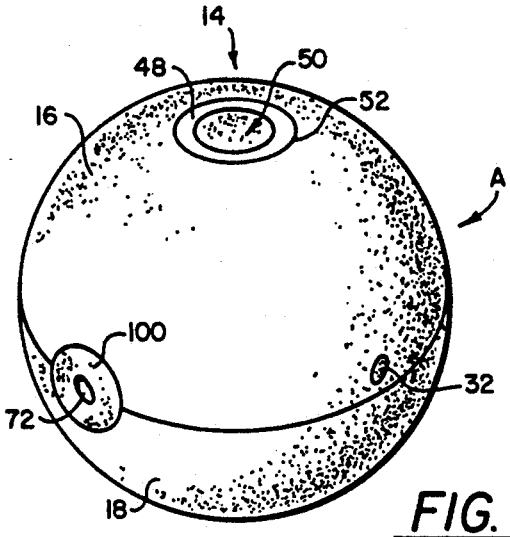
Figure 3:
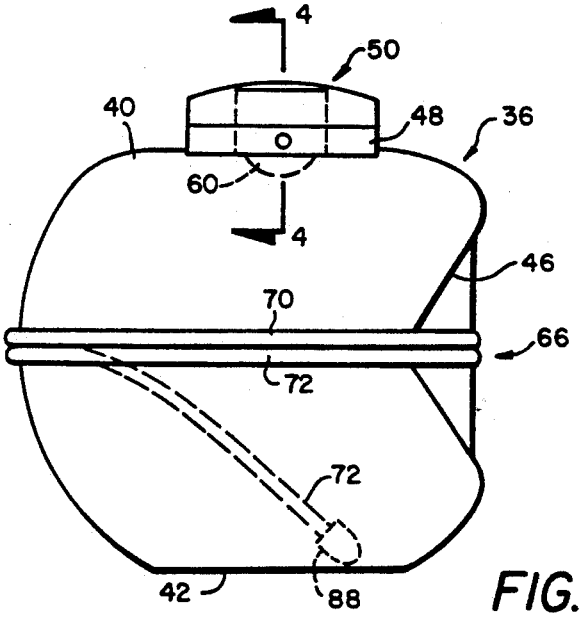
Figure 4:
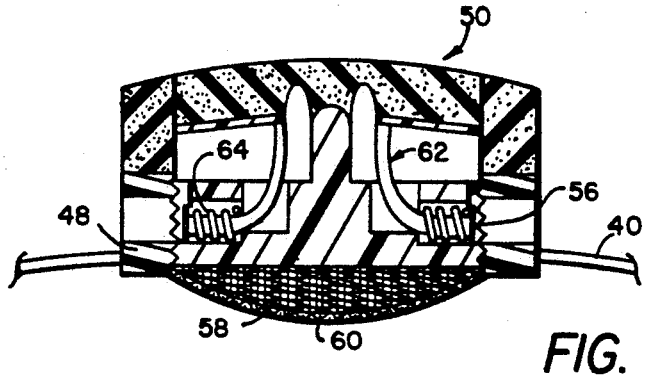
Figure 2:
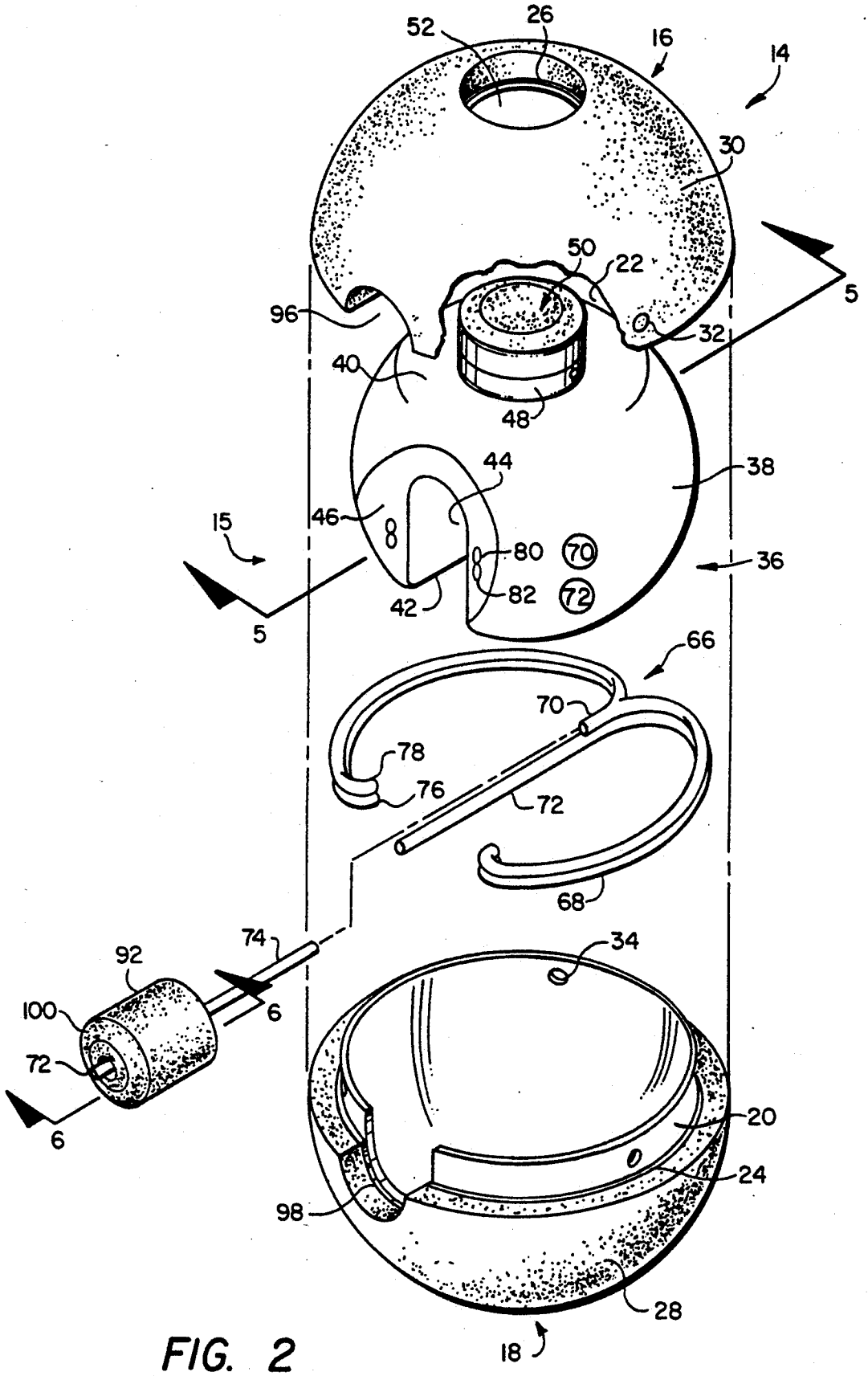
Figure 5:
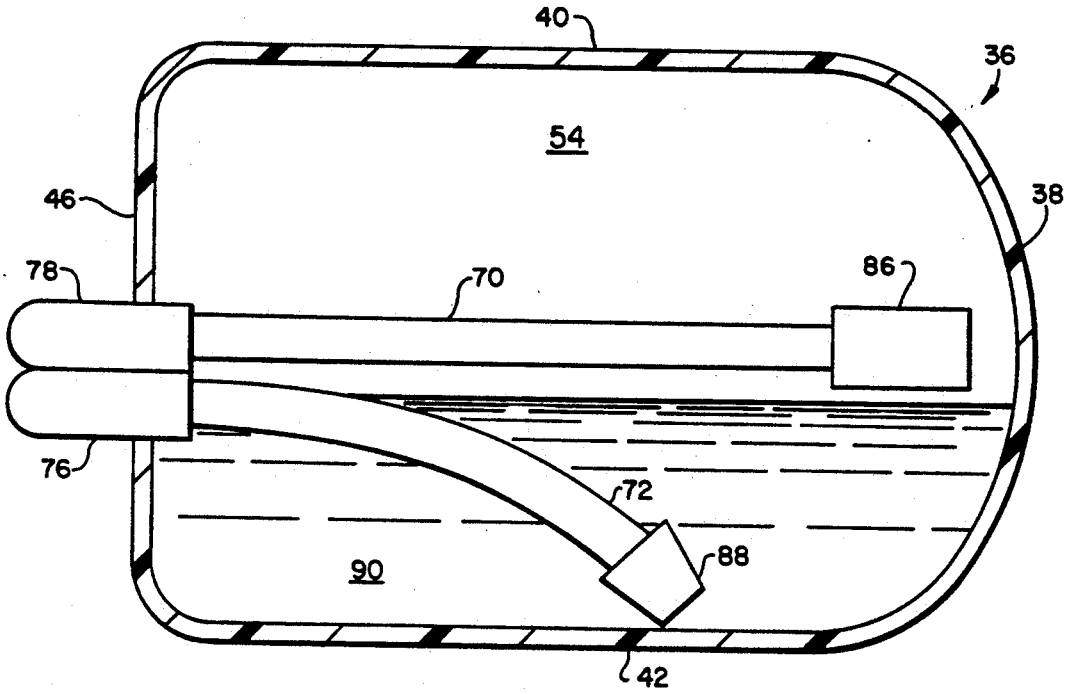
Figure 6A:
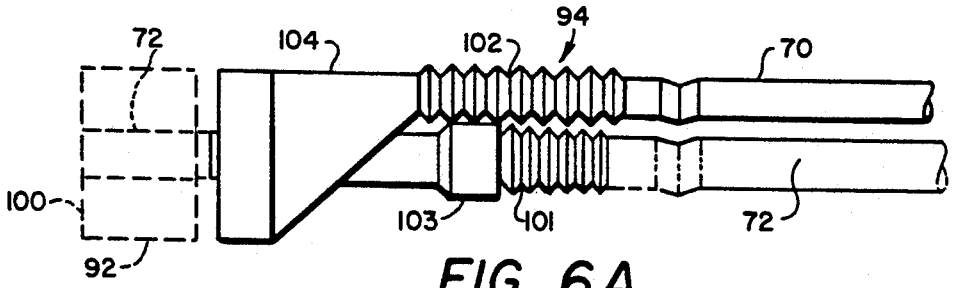
Figure 6B:
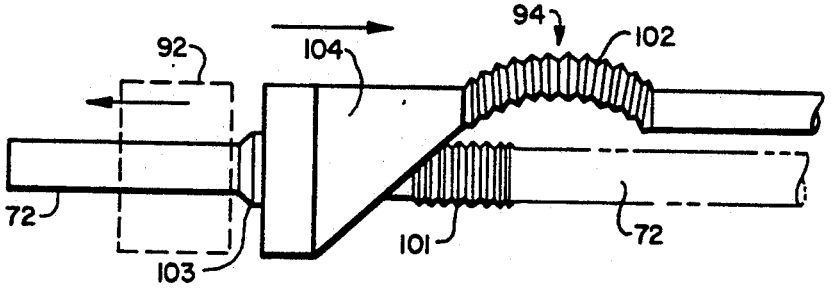
Figure 7:
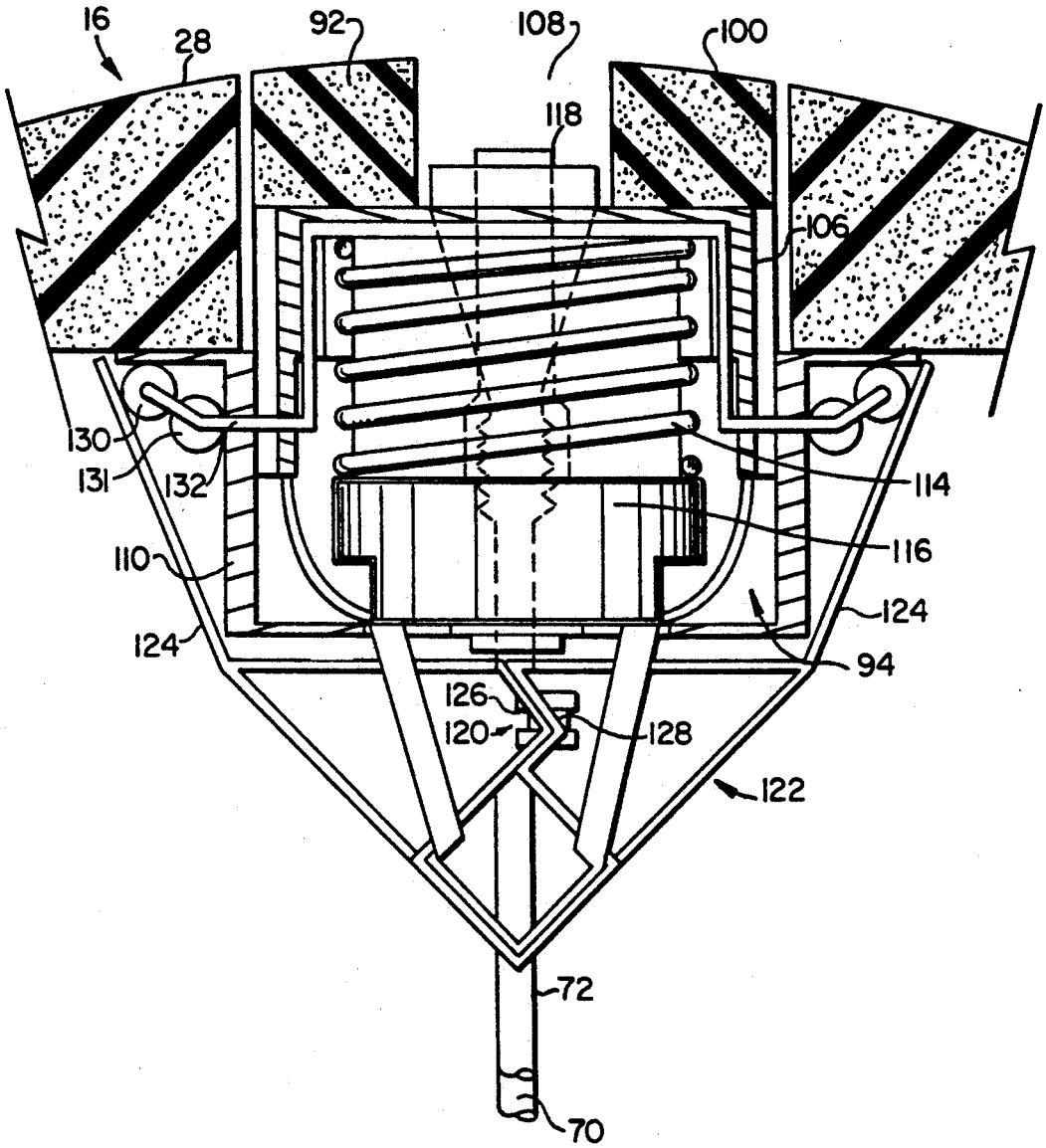
Figure 8:
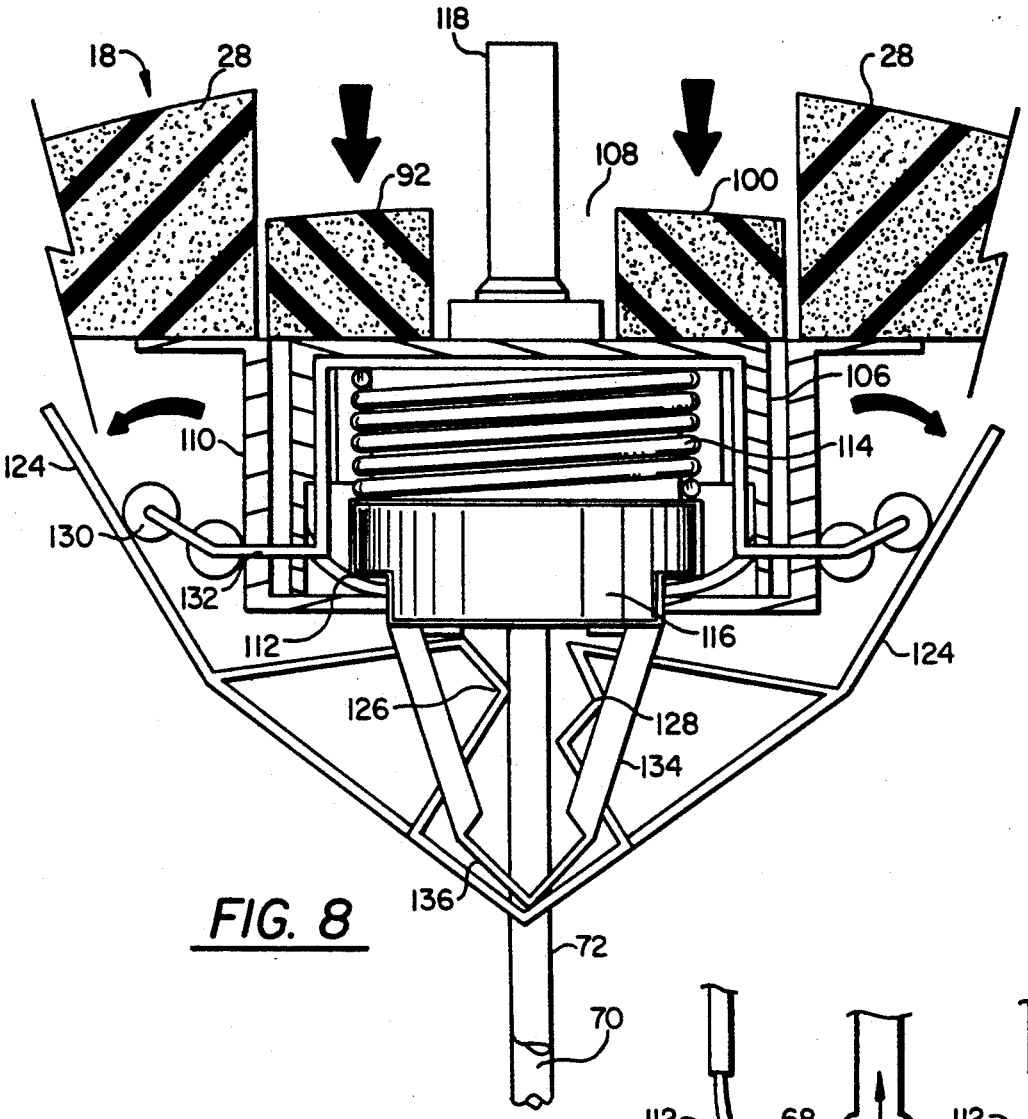
Figure 9:
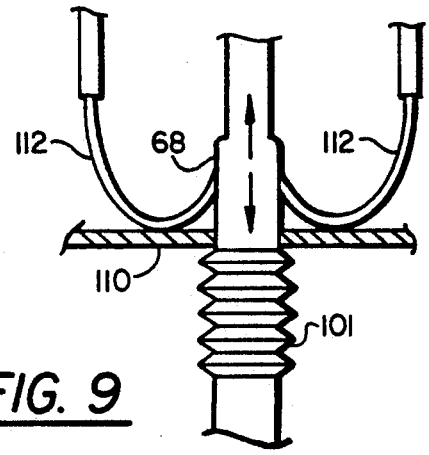
Figure 10A:
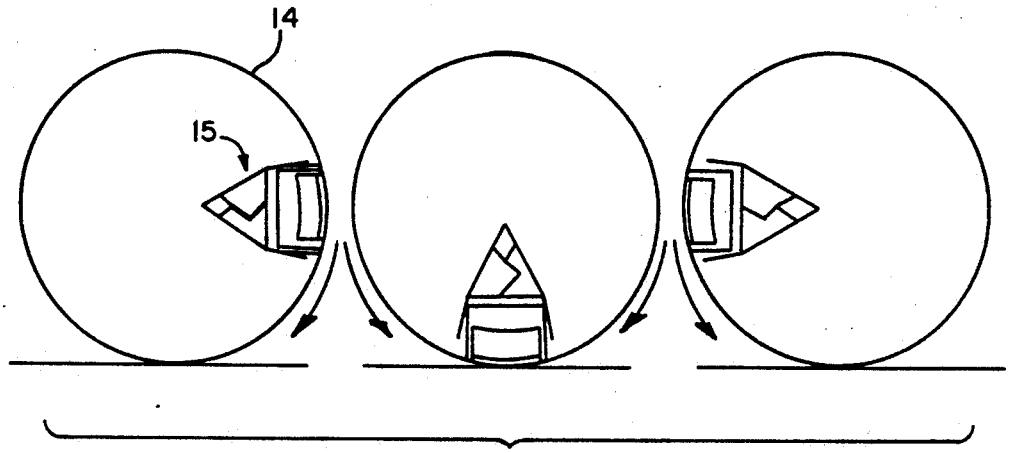
Figure 10B:
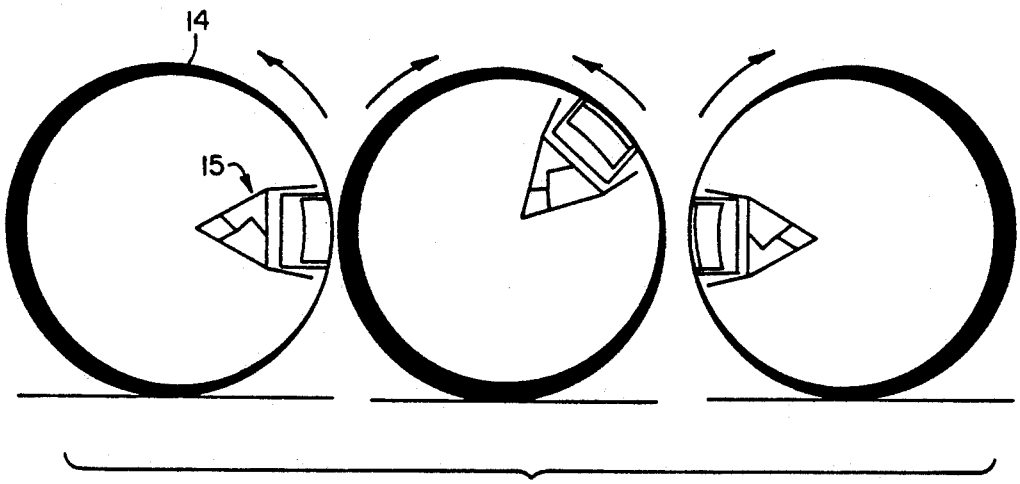

Having thus described the invention in general terms, reference will now be made to the accompanying drawings (six sheets) in which:

FIG. 1 is a perspective view of a combination toy and beverage dispensing device constructed in accordance with and embodying the present invention;

FIG. 2 is an exploded perspective view showing some of the major components of the combination toy and beverage dispensing device of the present invention;

FIG. 3 is a side elevational view of a beverage dispensing container forming part of the combination toy and beverage dispensing device;

FIG. 4 is a vertical section view taken along line 4—4 of FIG. 3;

FIG. 5 is a vertical sectional view of the beverage dispensing container taken substantially along line 5—5 of FIG. 2;

FIG. 6A is a fragmentary side elevational view, partially in section, showing a portion of an actuating means (in the unactuated position) forming part of the beverage dispensing mechanism included in the device of the present invention;

FIG. 6B is a fragmentary side elevational view, similar to FIG. 6A, and showing the actuating means of FIG. 6A in an actuated position to permit the dispensing of a liquid beverage from the beverage dispensing container of FIG. 5;

FIG. 7 is a side elevational view, partially broken away and in section, and showing a portion of a liquid delivery blocking mechanism (in the unactuated and blocking position) which is operable by the actuating means in order to block any liquid flow and to permit passage of liquid flow when the actuating means is actuated;

FIG. 8 is a fragmentary side elevational view, partially broken away and in section, and similar to FIG. 7 and showing the blocking mechanism in an alternate position when actuated;

FIG. 9 is a vertical sectional view showing a portion of the mechanism of FIGS. 7 and 8 and in particular, a mechanism for extending a liquid delivery tube;

FIG. 10A is a series of three composite schematic views showing the tendency for a combination toy and beverage dispensing device, in the nature of a ball, to assume one specific rest position if not properly weighted; and FIG. 10B is a series of three composite schematic views somewhat similar to FIG. 10A, and showing a free rotation of a toy playing ball when weighted properly in accordance with the present invention.

DETAILED DESCRIPTION OF A PREFERRED EMBODIMENT

Referring now in more detail and by reference characters to the drawings which illustrate a preferred embodiment of the present invention, A designates a combination toy and beverage dispensing device which is preferably in the form of a round spherical ball as best illustrated in FIG. 1 of the drawings. In this case, it should be understood that a ball is the preferred form of toy which may be constructed with this invention, although the ball could adopt an outer housing in numerous other shapes so as to be used as other forms of playing toys.

The combination toy beverage dispensing device A, in the preferred embodiment, includes as the major components thereof, a playing ball housing 14 in the manner as previously described and a beverage dispensing mechanism 15. This playing ball housing 14 is comprised of an upper ball section 16 and a lower ball section 18, as best illustrated in FIGS. 1 and 2 and the drawings. These two ball sections 16 and 18 are both semi-hemispherical and mate to become connected to one another as a true hemispherical ball in the manner as hereinafter described.

The ball housing 14 comprises a pair of semi-spherical shells 20 and 22, as best illustrated in FIG. 2, which are capable of being abutted together and secured together so as to form a round ball. A sponge-like relatively soft covering or liner 24 extends about the lower semi-cylindrical shell 20 in the manner as best illustrated in FIG. 2 and a similar sponge-like soft covering or liner 26 surrounds the upper shell 22. Finally, a resilient but yet structural outer rubber cap 28 surrounds the rubber liner 24 and a similar outer rubber cap 30 surrounds the sponge-like liner 26, also in the manner as best illustrated in FIG. 2. The outer rubber caps 28 and 30 are mainly to provide structural integrity to the ball and the inner liners 24 and 26 provide a degree of softness to the ball. It should be understood that any form of protective outer covering which provides the desired degree of resilience and softness could be employed.

The half shells are capable of being secured together by means of screws or like fasteners (not shown) which extend through screw holes 32 in the upper shell and 34 in the lower shell. Thus, when the two shells are snap-fitted together, the screw holes 32 and 34 are aligned in order to receive such screws or similar mechanical fasteners.

Located within the ball or outer housing is a beverage dispensing container 3 forming part of the beverage dispensing mechanism 15. This beverage dispensing container 36 is preferably in the form of a semi-rigid plastic material so as to be light in weight but sufficiently durable for use in the device A. Furthermore, the beverage dispensing container 36 has sufficient softness so as to permit the ball to yield upon an impact and thereby provide a degree of protection to the child user. The beverage dispensing container 3 is generally somewhat hemispherical in shape, as best illustrated in FIGS. 2 and 3 of the drawings, and has an outer somewhat cylindrical side wall 38, although it is provided with a relatively flat top wall 40 and a relatively flat bottom wall 42. In addition, the beverage dispensing container 36 is also provided with a longitudinally extending vertically arranged slot 44 to extend therethrough from one side to the other. On one side, the spherical side wall 38 is provided with a cut-away relatively flat section 46, as best illustrated in FIGS. 2 and 3 of the drawings.

The beverage dispensing container 36 is also provided on its top wall 40 with a cylindrically shaped neck 48 which removably receives a filler cap 50. By further reference to FIG. 2 of the drawings, it can be observed that the filler cap 50 protrudes through a circularly-shaped opening 52 formed in the upper hemispherical ball section 16. In this way, the filler cap 50 can be unthreaded from the neck 48 for introduction of a liquid through the neck and into an interior chamber 54 formed in the beverage dispensing container 36. The cap is provided with an outer surface having a shape and material conforming to that of the remainder of the ball.

The neck 48 is provided with a threaded section 56 which mates with a similar threaded section on the exterior of the cap 50, as best shown in FIG. 4. The neck 48 is also provided with a filter 58 held at the upper end of the inlet to the interior chamber 54 by means of a screen 60. Thus, when milk or other beverage is introduced into the chamber 54, the filter 58 will filter out any impurities or solid matter contained therein. The filter material 58 may adopt the form of a filter gauze and can be removed and cleaned.

The cap is provided with a pair of arcuately shaped pins 62 which are adapted to extend into and engage one of the grooves of the threaded section 56 on the neck. Moreover, the pins 62 are spring-biased into engagement with the neck by means of compression springs 64 concentrically disposed around the ends of the pins 62. In this way, the child user cannot attempt to remove the cap since the strength of an adult would be required to turn the same.

The present invention also includes a device referred to as a "stem means" 66 which serves to permit both an introduction of external air into the interior chamber 54 of the beverage dispensing container 36 and to also permit a delivery of the beverage contained in the chamber 54 of the beverage dispensing container 36. It should be understood in connection with the preferred embodiment that the term "beverage" is used in a broad sense to refer to essentially any liquid, although the device is primarily adapted for the dispensing of milk.

The stem means 66 generally comprises a pair of tubes including a liquid or beverage delivery tube 68 and an air supply tube 70. By reference to FIG. 2, it can be seen that the tubes 68 and 70 exist in a pair. Each of the tubes extend substantially cylindrically around the beverage dispensing container 36 as best illustrated in FIGS. 2 and 3, and are provided with elongate tube sections 72 and 74, respectively, which extend through the elongate slot 44 in the container 36. Moreover, each of the tubes 68 and 70 have in-turned ends 76 and 78, respectively, which extend through pairs of openings 80 and 82, respectively, in the flat wall section 46 of the beverage dispensing container 36. In this way, the tubes 58 and 60 which are sealed in the openings 70 and 72, communicate with the interior chamber 54.

By reference to FIG. 5, it can be observed that the air tube 70 terminates in the interior chamber 54 of the beverage dispensing container 36 and is provided with a relatively fixed inner end 86. The interior or inner end of the beverage delivery tube 72 is provided with an enlarged plastic weight 88 so as to allow the tube to drop with the force of gravity. In this way, the lower end of the beverage delivery tube 72 will always be located in a liquid beverage 90 contained within the beverage dispensing container 36, as best illustrated in FIG. 5, regardless of the orientation of the toy and hence, regardless of the orientation of the beverage dispensing container 36.

The beverage dispensing tube 72 and the air supply tube 70 both project through a plug 92 forming part of an actuating means 94, as hereinafter described in more detail. This plug 92 is located at the outer surface of the ball or housing 14. Moreover, it can be observed that the two ball sections 16 and 18 are each provided with semi-circular openings 96 and 98 in order to receive the plug 92. The outer surface of the plug 92 is provided with an arcuate surface configuration 100, generally conforming to the radius of curvature of the hemispherical ball sections 16 and 18. Further, the air supply tube 70 will operatively terminate at the arcuate surface 100 of the plug 92 in a manner to be hereinafter described in more detail and the beverage delivery tube 72 will extend to and may project through the plug 92.

The liquid delivery tube 72 is also shiftable in a manner to be hereinafter described in more detail in accordance with actuation by pressing on the plug 92. In this case, when the plug 92 is pushed inwardly by pressure from the lips of the child user on the surface of the plug 92, the liquid delivery tube 72 will extend outwardly with respect to the outer surface of the ball. When pressure is released form the plug 92, the liquid delivery tube 72 will retract, by means of the mechanism illustrated in FIGS. 7 and 8 and which is hereinafter described in more detail.

A spring mechanism 101 is also located in the elongate tube section 72 forming part of the beverage delivery tube 68. This spring may actually surround a portion of the beverage delivery tube 68 or it may preferably adopt the form of a bellows so as to be incorporated in the tube section 72, as best illustrated in FIG. 6A. The spring or bellows 101 bears against an enlarged hub 103 also mounted on the exterior surface of the tube section 72, also as best illustrated in FIG. 6A of the drawing.

By reference to FIG. 6B, it can be observed that the spring or bellows 101 becomes collapsed when the beverage delivery tube 68 is biased to extend outwardly of the plug 92. Thus, when the child user releases the engagement of the outer end of the beverage delivery tube 68, it will be automatically retracted within the outer shell by means of the expansion of the spring or bellows 101. The hub 103 also defines a limit of outermost movement of the beverage tube 68.

The pumping means 94 is designed to introduce air into the interior chamber 54 of the liquid dispensing container 36. The air may be used to positively drive the liquid through the liquid delivery tube 72, or it may be used to equalize pressure between the external atmosphere and that of the chamber 54 as liquid is withdrawn therefrom. In absence of some means for equalizing the pressure, the withdrawal of liquid from the chamber 54 would cause a negative pressure in the chamber. This would make it more difficult for the child user to continue to suck liquid from the chamber 54. Thus, the air tube will introduce a sufficient quantity of air through the pumping means, as hereinafter described, in order to compensate for this negative pressure differential which would otherwise arise. By using a sufficiently sized pumping means, sufficient air pressure can be introduced into the chamber 54 in order to literally force the liquid through the liquid delivery tube 72, or to function as an aid in the withdrawal of liquid.

The pumping means 94 comprises a bellows 102 in the air tube 70. By reference to FIG. 6A, it can be observed that the liquid delivery tube 72 has an outer surface which is almost co-planar and flush with the outer surface 100 of the plug 92. The bellows 102 opens into an inlet funnel 104 which is, in turn, connected to the inner side of the plug 92. (The funnel 104 has not been shown in FIGS. 2, 7 and 8 for purposes of clarity.) The funnel 104 is connected to the plug 92 in such manner in that the entire plug itself, due to its porous nature, serves as a conduit for delivery of air through the plug from the outer surface 102 directly into the funnel 104. Thus, only the single liquid delivery tube 72 can project outwardly of the plug 92.

By reference to FIG. 6B, it can be observed that when the child user pushes against the outer surface 100 of the plug 92, the funnel 104 is pushed inwardly thereby compressing the bellows 102. The bellows 102 may also be displaced slightly, adopting somewhat of an arcuate shape as illustrated in FIG. 6B. Nevertheless, the amount of air in the bellows 102 is forced through the air tube 70 and into the chamber 54 of the liquid dispensing container 36. Expansion of the bellows 102 will again permit the bellows to be in a position of pumping additional air into the chamber 54 when the child user next presses against the plug 92. Even if the child user holds the plug inwardly, there will be a complete liquid flow path directly through the liquid delivery tube 72 and hence, the child user can suck the milk or other beverage from the chamber 54 much in the same manner as sucking through a straw.

If desired, a type of check valve can be inserted in the air tube 70 in order to preclude a withdrawal of air from the liquid chamber 54 when the bellows 102 is allowed to expand. Any form of conventional check valve could be employed for this purpose and therefore, no particular valve is illustrated or described herein.

FIGS. 7 and 8 more fully illustrate the details of the actuating mechanism and a flow restricter means, often referred to as a blocking means, associated therewith. FIG. 7 illustrates the position of the actuator mechanism when the plug 92 remains in its unactuated position, that is, where its outer surface 100 is flush with the outer surfaces 30 and 28 of the ball sections 16 and 18, respectively. For purposes of clarity, the air tube 70, the associated bellows 102 and funnel 104 have not been illustrated in FIGS. 7 and 8. The liquid delivery tube 72, however, has been illustrated.

In FIG. 7, it can be seen that the plug 92 is not mounted directly on the funnel 104, but rather, is disposed in operative relation to the funnel so that air drawn from the plug is introduced directly into the funnel and hence, into the air tube 70. The plug 92 is rigidly secured to a somewhat U-shaped steel cup-like member 106. It can also be observed that since the plug 92 is provided with a central bore 108 it permits air flow into the funnel 104. Thus, and in this respect, the plug 92 is mounted in relationship to the funnel 104.

An actuating mechanism support frame 110, which may be in the form of a U-shaped cup member, is mounted on the interior surface or so-called "underside" of one of the semi-spherical ball sections, such as the section 16, as best illustrated in FIGS. 7 and 8 of the drawings. This frame 110 receives the inverted cup-like member 106, also in the manner as illustrated, and the cup-like member is supported therein by means of a plurality of arcuately shaped tension spring arms 112. The cup-like member 106 is normally biased so that the plug 92 is shifted to its unactuated position, that is, a position where the outer surface 100 conforms to the outer surface 28 of the ball section 16. The biasing force is caused by a compression spring 114 which bears against the undersurface of the inverted cup-like member 106 and also bears against a plastic bearing block 116 mounted on the upper surface of the frame 110. In this way, it can be observed that the plug 92 is biased to the unactuated position.

When the plug 92 is pushed inwardly by the action of the user pressing his or her lips against the outer surface 100, it can be observed that the compression spring 114 is compressed, as best illustrated in FIG. 8 of the drawings. Moreover, this causes an extending of the liquid delivery tube outwardly somewhat with respect to the surface of the ball, as best illustrated in FIG. 8 of the drawings. Further, by reference to FIGS. 7 and 8 of the drawings, it can be observed that a diameterally enlarged mouth piece 118 may be located on the outer end of the liquid delivery tube 72.

The tension spring arms 112 of the actuating mechanism also causes the outward shifting movement of the beverage delivery tube 68. In this case, when the child user of the device pushes on the outer hemispherical surface 100 of the plug 92, the latter will be pushed inwardly, as best shown in FIG. 8. As this occurs the arms 112 will bear against the bottom wall of the mechanism support frame 110, as best illustrated in FIG. 9. The arms 112 will then assume more of an arcuate shape and since their ends are connected to the beverage delivery tube 68, the latter will be pushed upwardly and outwardly with reference to FIG. 9. As indicated previously, the beverage delivery tube will be returned to its initial inward position when not in use by means of the bellows 101 which operates as a type of spring.

A flow restricting means 120 also forms part of the actuating mechanism and is also more fully illustrated in FIGS. 7 and 8 of the drawings. The flow restricting means comprises a metal frame 122 which is located on the underside of the frame 110 and includes a pair of upwardly and outwardly diverging arms 124. The frame 122 also comprises a V-shaped projection 126 which is capable of engaging the liquid delivery tube 72 between the V-shaped projection 126 and a V-shape trough 128. In this way, the V-shaped projection 126 and the trough 128, which are respectively mounted on the arms 124, will operate as a type of valve or restricter.

When the actuating mechanism is in the position as illustrated in FIG. 7, that is, the unactuated position, the flow restricter means 120 will be closed, thereby blocking any liquid flow from the chamber 54 through the liquid delivery tube 72. However, when the child user pushes against the plug 92, the plug 92 will be pushed inwardly as shown in FIG. 8, and the arms 124 will be shifted outwardly to the position as illustrated in FIG. 8. In addition, the V-shaped projection 126 will be spaced from the V-shaped trough 128, thereby allowing a complete liquid flow through the liquid delivery tube 72.

The arms 124 are shifted apart to the position as illustrated in FIG. 8 by means of rollers 130 which are mounted on outwardly extending rods 132 and the latter of which, in turn, are operatively secured to the inverted cup-like member 106. An additional roller 131 is also mounted on each of the outwardly extending rods 132, as best illustrated in FIGS. 7 and 8, and which are adapted to bear against the exterior surface of the frame 110. Furthermore, in the arrangement as illustrated, the rollers 130 and 132 are each in engagement with one another. As the child user pushes downwardly on the plug 92, the rollers 130 will bear against the arms 124, causing the latter to shift to the position as illustrated in FIG. 8. As this occurs, the V-shaped projection 126 will separate from the V-shaped trough 128, eliminating any restriction in the liquid delivery tube 72 which occurs normally by the crimping action.

It can be seen that the flow restricting means is simple in operation, but highly effective. In this way, when the user pushes downwardly on the plug 92, there is a complete liquid flow from the chamber to the user's mouth. However, when the child user releases the pressure against 92, it will be biased outwardly, permitting the crimping action of the tube 70 and hence, a complete cessation of fluid flow therethrough. With this construction, there is no possibility of leakage of the beverage while the device is being used as a toy.

Mounted on the underside of the block 116 and being moveable therewith, is a pair of downwardly extending struts or legs 134 and which terminate in fingers 136 in the manner as illustrated in FIGS. 7 and 8 of the drawings. These struts 134 are designed to connect to the various frame legs 124 and hold the same in position during movement thereof.

As indicated previously, the entire beverage dispensing mechanism, which includes essentially those components illustrated in FIGS. 5–8 of the drawings, is mounted on one side of the playing ball. Thus, the center of gravity of the ball would be offset from the true axial and diametrical center of the ball. As a result, the ball would roll in such manner that the heavily weighted portion of the mechanism 15 thereof would rest when it achieved a lower-most position. FIG. 9A of the drawings illustrate the beverage dispensing mechanism on opposite sides of the ball in two exterior views. The interior or middle view of FIG. 9A clearly show how the ball would come to rest with the liquid dispensing mechanism mounted at one side of the ball.

In order to obviate and overcome this problem and to enable a rolling movement of an unbalanced ball, the outer shell is provided with a greater thickness of material and hence, greater weight, on the side opposite to the beverage dispensing mechanism. In this case, it can be observed that the outer shell progressively increases in thickness slightly along the circumference thereof in proportion to the distance away from the liquid dispensing mechanism. The portion of the shell diameterally opposite the dispensing mechanism would have the greatest thickness as illustrated in FIG. 9B. Thus, it can be observed in accordance with FIG. 9B that the ball will freely rotate as though it were evenly weighted along all portions of the angular surface thereof.

Thus, there has been illustrated and described a unique and novel combination to and beverage dispensing device which permits play with the toy by a child user and also which permits dispensing of a beverage contained therein. The device of the present invention therefore, fulfills all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what I desire to claim and secure by letters patent is:

1. A novel toy-beverage dispensing device for child users capable of being used as a toy and also for dispensing beverages contained therein, said device comprising:

a) an outer housing having a central interior compartment;

b) a beverage dispensing container located within the central interior compartment of said housing and containing a liquid beverage capable of being dispensed therefrom;

c) stem means communicating with the beverage in the container and projecting outwardly from the container and capable of extending at least to the surface of the outer housing;

d) actuable means operatively associated with the stem means causing the stem means to be in liquid flow communication with the beverage when engaged by the lips of the child user to withdraw a liquid beverage from the beverage container; and e) flow restrictor means operatively connected to said actuable means and being actuated to permit fluid flow through the stem means only when the stem means is engaged by the lips of the child user, and the flow restrictor means being automatically actuated to crimp the stem means and which prevents fluid flow through the stem means when not engaged by the lips of a child user, thereby enabling the device to be used as a toy regardless of its orientation without any spillage of the beverage.

2. The novel toy-beverage dispensing device of claim 1 further characterized in that the outer housing is generally spherical and the housing is comprised of a pair of semi-spherical housing sections which are capable of being abutted together and separable to allow access to the interior of the container.

3. A novel toy-beverage dispensing device for child users capable of being used as a toy and also for dispensing beverages contained therein, said device comprising:

a) an outer housing having a central interior compartment;

b) a beverage dispensing container located within the interior compartment of said housing and containing a liquid beverage capable of being dispensed therefrom;

c) stem means including a tube communicating with the beverage in the container and projecting outwardly from the container and capable of extending at least to the surface of the outer housing;

d) actuable means operatively associated with the stem means causing the stem means to be in liquid flow communication with the beverage when engaged by the lips of the child user to withdraw a liquid beverage from the beverage container, and where the actuable means blocks liquid flow communication when the stem means is not engaged by the lips of a child user, thereby permitting the device to be used as a toy;

e) a plug forming part of said actuable means and which surrounds the outer end of the stem means in proximity to the surface of the device, said plug capable of being pushed inwardly when the outer end of the stem means is engaged by the lips of a child user; and f) a flow restrictor means connected to said plug and operable by said actuable means to permit liquid flow communication to the outer end of the tube when the plug is pushed inwardly and which automatically blocks liquid flow communication through the tube when the user releases his or her lips from the stem means, and also permitting the plug to move toward the outer end of the stem means.

4. The novel toy-beverage dispensing device of claim 3 further characterized in that a pumping means is associated with the stem means and permits a desired pressure balance between the beverage dispensing container and the external atmosphere.

5. The novel toy-beverage dispensing device of claim 3 further characterized in that the actuable means comprises a bellows type member located intermediate to the inner end of the stem means and tan outer end of the stem means with the outer end serving as a lip-engaging end.

6. A beverage dispensing device for use by child users comprising:

a) a beverage dispensing container having a central chamber for holding drinkable beverage;

b) a beverage delivery tube extending into said chamber and having an inner end disposed in a beverage contained in the chamber and an outer end capable of being engaged by the user to draw a beverage from the container, c) an air tube operatively associated with the beverage delivery tube and extending into the chamber and having an end outwardly of the chamber, d) a plug member located at the surface of the device and which is also engagable by the lips of a user of the device when engaging the end of the beverage delivery tube, said beverage tube extending through said plug member and being independently moveable with respect to the plug member, e) pumping means operatively connected to the plug member and associated with the air tube and being actuable when the user engages the outer end of the delivery tube for introducing air into the central chamber, and f) actuable means operative associated with the delivery tube and air tube and automatically causing movement of the delivery tube outwardly of the container when a child user engages and pushes on the plug member.

7. The novel toy-beverage dispensing device of claim 6 further characterized in that a flow restricting means is associated with the beverage delivery tube and is operable to automatically stop all liquid flow when the child user does not engage the delivery tube and plug member and to automatically open and permit beverage delivery when the child user does engage the delivery tube.

8. A novel toy-beverage dispensing device for child users capable of being used as a toy and also for dispensing beverages contained therein, said device comprising:

a) an outer housing having a central interior compartment;

b) a beverage dispensing container located within the central interior compartment of said housing and containing a liquid beverage capable of being dispensed therefrom;

c) stem means comprising a flexible inner tube having an inner end communicating with the beverage in the container and projecting outwardly from the container and capable of extending at least to the surface of the outer housing;

d) said inner end of the tube being weighted so as to remain in the beverage by a gravity action regardless of the orientation of the container;

e) actuable means operatively associated with the stem means causing the stem means to be in liquid flow communication with the beverage when engaged by the lops of the child user to withdraw a liquid beverage from the beverage container; and f) flow restrictor means operatively connected to said actuable means and being actuated to permit fluid flow through the stem means only when the stem means is engaged by the lips of the child user, and the flow restrictor means being automatically actuated to prevent fluid flow through the stem means when not engaged by the lips of a child user, thereby enabling the device to be used as a toy regardless of its orientation with any spillage of the beverage.

9. A novel toy-beverage dispensing device for child users capable of being used as a toy and also for dispensing beverages contained there, said device comprising:

a) an outer housing having a central interior compartment;

b) a beverage dispensing container located within the central interior compartment of said housing and containing a liquid beverage capable of being dispensed therefrom;

c) stem means comprising a flexible inner tube having an inner end communicating with the beverage in the container and projecting outwardly from the container and capable of extending at least to the surface of the outer housing;

d) actuable means operatively associated with the stem means causing the stem means to be in liquid flow communication with the beverage when engaged by the lops of the child user to withdraw a liquid beverage from the beverage container; and e) said actuable means comprising a plug which surrounds the outer end of the stem means in proximity to the surface of the device and which plug is capable of being pushed inwardly when the outer end of the stem means is engaged by the lips of a child user;

f) flow restrictor means operatively connected to said actuable means and being actuated to permit fluid flow through the stem means only when the plug is engaged by the lips of the child user and pushed inward, and the flow restrictor means being automatically actuated to prevent fluid flow through the stem means when not engaged by the lips of a child user thereby enabling the device to be used as a toy regardless of its orientation without any spillage of the beverage.

10. The novel toy-beverage dispensing device of claim 9 further characterized in that a pumping means is associated with the stem means and is automatically operable when a child user engages the plug with his or her lips and pushes on same to thereby permit a desired pressure balance between the beverage dispensing container and the external atmosphere.

11. A novel toy-beverage dispensing device for child users capable of being used as a toy and also for dispensing beverages contained therein, said device comprising:

a) an outer housing having a central interior compartment;

b) a beverage dispensing container located within the central interior compartment of said housing and containing a liquid beverage capable of being dispensed therefrom;

c) stem means having an inner end communicating with the beverage in the container and an outer end projecting outwardly from the container and capable of extending at least to the surface of the outer housing so that the outer end serves as a lip engaging end;

d) a bellows type actuable means located intermediate the inner end and the outer end of the stem means and causing the stem means to be in liquid flow communication with the beverage when engaged by the lips of the child user to withdraw a liquid beverage from the beverage container; and e) flow restrictor means operatively connected to said actuable means and being actuated to permit fluid flow through the stem means only when the stem means is engaged by the lips of the child user, and the flow restrictor means being automatically actuated to prevent fluid flow through the stem means when not engaged by the lips of a child user, thereby enabling the device to be used as a toy regardless of its orientation with any spillage of the beverage.

* * * * *